United States Patent [19]

Heyraud

[11] Patent Number: 4,669,319

[45] Date of Patent: Jun. 2, 1987

[54] ELECTRONIC TORQUE WRENCH

[75] Inventor: Georges Heyraud, Saint Just Malmont, France

[73] Assignee: Forges Stephanoises S.A., Saint-Etienne, France

[21] Appl. No.: 757,614

[22] Filed: Jul. 22, 1985

[30] Foreign Application Priority Data

Jul. 23, 1984 [FR] France ..... 8411917

[51] Int. Cl.[4] ..... B25B 23/142

[52] U.S. Cl. ..... 73/962.23; 81/477

[58] Field of Search ..... 73/862.21, 862.23, 862.26; 81/467, 477, 479

[56] References Cited

U.S. PATENT DOCUMENTS 4,558,601 12/1985 Stasiek et al. ..... 73/862.23

4,562,746 1/1986 Petit ..... 73/862.23

*Primary Examiner*—Charles A. Ruehl

*Attorney, Agent, or Firm*—Karl F. Ross; Herbert Dubno

[57] ABSTRACT

A torque wrench according to the invention has a rigid elongated body having a tool end adapted to be rotationally fixed to a part to which a predetermined desired torque is to be applied and an opposite handle end. Transducers including strain gauges connected between the tool end and the body generate an actual-value output corresponding to the actual torque being applied by the wrench to the part rotationally coupled to the tool end. A display connected to the transducers reads out torque and an input device generates a desired-value output corresponding to the desired torque to be applied by the wrench to the part rotationally coupled to the tool end. A first comparator connected to the transducer and input device compares the actual-value and desired-value signals and generates an alarm signal when the actual torque is substantially the same as the desired torque. In accordance with this invention a second comparator compared the actual torque with a relatively low threshold torque. A switch circuit connected between the display on one side and the transducer and second comparators on the other side feeds the desired-value signal to the display when the actual torque lies below the relatively low threshold torque and alternately feeds the actual-value signal to the display when the actual torque exceeds the threshold torque.

10 Claims, 4 Drawing Figures

ELECTRONIC TORQUE WRENCH

FIELD OF THE INVENTION

The present invention relates to a torque wrench. More particularly this invention concerns such a wrench incorporating electronic elements to measure and display torque.

BACKGROUND OF THE INVENTION

A standard electronic-type torque wrench such as described in French Pat. No. 2,261,843 has a rigid elongated body having a tool end adapted to be rotationally fixed to a part to which a predetermined torque is to be applied and an opposite handle end. Transducers including strain gauges connected between the tool end and the body generate an actual-value output corresponding to the actual torque being applied by the wrench to the part rotationally coupled to the tool end. A display described in particular detail in French Pat. Nos. 2,296,835 and 2,400,996 connected to the transducers shows the actual torque. A normally button-type input device is used to generate a desired-value output corresponding to the desired torque to be applied by the wrench to the part rotationally coupled to the tool end and a comparator connected to the transducer and input means compares the actual-value and desired-value signals and generates an alarm signal when the actual torque is substantially the same as the desired torque.

Thus with this type of tool the desired torque is set by the input device, then the tool end, which is typically provided with an appropriately sized box or socket head, is fitted over the nut or bolt to be torqued down. The increasing torque applied is displayed so the user can monitor how close he or she is getting to the desired torque, and when the desired torque is reached the alarm signal, normally a beep or the like, alerts the user to stop.

Such arrangements are often fairly inconvenient when only used infrequently. To start with they must be programmed meticulously, and the display must be monitored carefully so the user is sure that the desired torque has not been improperly inputed. Similarly, after use the device must be turned off to conserve power as the battery source is typically fairly weak, and for reuse, even at the same desired torque, the system must be reprogrammed. In addition the user must normally work fairly carefully with the tool, watching the display, to avoid inadvertently going past the desired torque since at the time the alarm is given the user is usually applying considerable force to the handle end and cannot rapidly release.

OBJECTS OF THE INVENTION

It is therefore an object of the present invention to provide an improved electronic torque wrench.

Another object is the provision of such a electronic torque wrench which overcomes the above-given disadvantages, that is which is easy to program and use, and that conserves power automatically.

SUMMARY OF THE INVENTION

A torque wrench according to the invention has a rigid elongated body having a tool end adapted to be rotationally fixed to a part to which a predetermined desired torque is to be applied and an opposite handle end. Transducers including strain gauges connected between the tool end and the body generate an actual-value output corresponding to the actual torque being applied by the wrench to the part rotationally coupled to the tool end. A display connected to the transducers reads out torque and an input device generates a desired-value output corresponding to the desired torque to be applied by the wrench to the part rotationally coupled to the tool end. A first comparator connected to the transducer and input device compares the actual-value and desired-value signals and generates an alarm signal when the actual torque is substantially the same as the desired torque. In accordance with this invention a second comparator compared the actual torque with a relatively low threshold torque. A switch circuit connected between the display on one side and the transducer and second comparators on the other side feeds the desired-value signal to the display when the actual torque lies below the relatively low threshhold torque and alternately feeds the actual-value signal to the display when the actual torque exceeds the threshold torque.

Thus with the system of this invention the same display shows the desired torque as same is set and when the wrench is not in use, and automatically switches over to show the actual torque when the wrench is applying more than a modest torque, say 15 Nm, to the part being tightened or loosened. The switchover is wholly automatic so the user is always provided with just the information needed at any particular time. When the wrench is not in use, the display reads out the desired torque, and when it is in use it shows the actual torque.

According to a feature of this invention the displays includes a memory for retaining and displaying for a limited time the actual torque even when same drops briefly below the threshold torque. Thus each time the user repositions the tool or changes grip, the display does not blank out. A hold of approximately 5 sec is enough to accomplish this.

In addition the first comparator includes distinct first and second alarms and means for actuating the first alarm when the actual torque is a predetermined fraction of the desired torque and for actuating the second alarm when the actual torque is generally equal to the desired torque. Thus when, for instance, the actual torque is equal to nine-tenths of the desired torque, the first alarm, which according to another feature of this invention is an audible beep, goes off, warning the user to take it easy until the second alarm which according to this invention is a visible lamp or light, or even part of the numeric display, indicates the desired torque has been reached. This feature allows the user to work very rapidly, without worrying about overshooting the desired torque.

The power supply of the tool according to the invention is set up to automatically deenergize all the circuits and shut off the tool when the wrench is not used within a predetermined time span. This is best accomplished by providing it with a timer which shuts off the electricity after a predetermined time, typically 3 min, if the actual torque does not exceed the threshold torque within the predetermined time span. Thus if used continuously the wrench will stay on, but if set down it will turn itself off after a while and thereby conserve its battery.

In accordance with another feature of this invention the transducer is set up so that the actual-value signal is independent of torque direction. This feature makes it possible to use the tool in either direction for reversethreaded parts or to test how tight something is, and to use it upside-down if desired. In addition the display includes a nonvolatile memory for retaining the actual-value signal even if the wrench is turned off. Thus the tool need not be reset if used within, say, 3 hr, even if it has been turned off or has turned itself off automatically.

DESCRIPTION OF THE DRAWING

The above and other features and advantages will become more readily apparent from the following, reference being made to the accompanying drawing in which.

SPECIFIC DESCRIPTION

Figure 1:
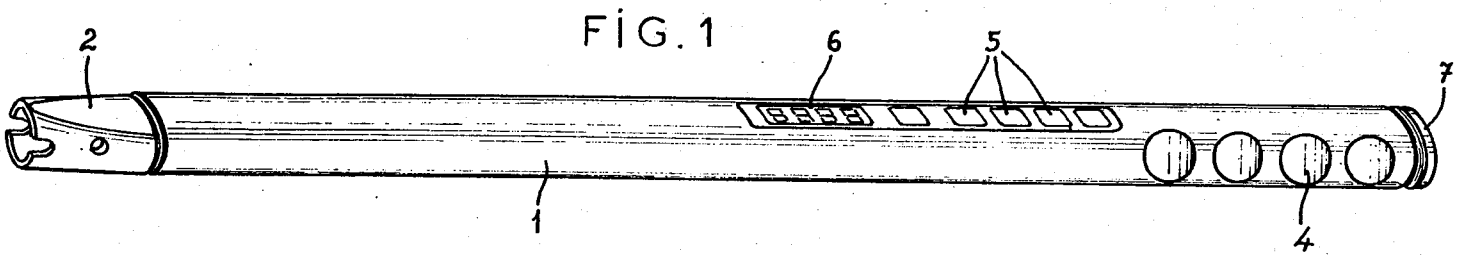
FIG. 1 is a perspective view of the torque wrench according to this invention.

As seen in FIG. 1 the wrench according to this invention has an elongated oval-section body 1 having a tool end 2 adapted to receive a fitting 3 such as the illustrated box wrench, and an opposite end 4 that is transversely fluted to afford a good grip for the hand. One broad face of the body 1, normally that face turned toward the user gripping the handle end 4 when in use, is provided with a plurality of input/control buttons 5 and with a small four-digit liquid-crystal display 6. The handle end 4 of the wrench body 1 is provided with a removable cap 7 in which a small battery 8 is held. As will be described in more detail below, the input buttons 5 are used to set the desired torque to be applied by the tool, and the display 6 reads out either this desired torque or the actual torque being exerted by the tool on whatever part is in the wrench fitting 3. Internally the body 1 holds a circuit board 11 carrying circuit elements 12 and 13 as well as the display 6 and an audible alarm 23.

Figure 2:
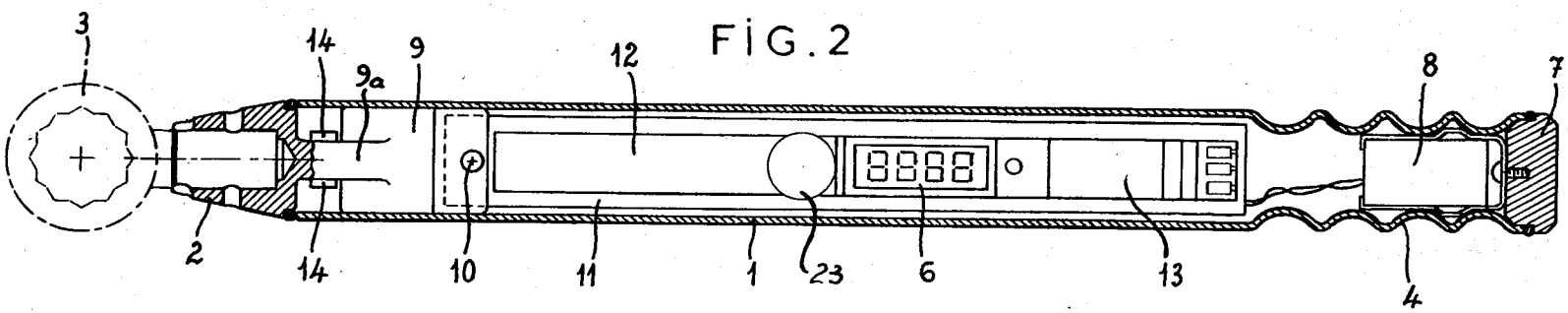
FIG. 2 is an axial section through the wrench of FIG. 1.
Figure 3:
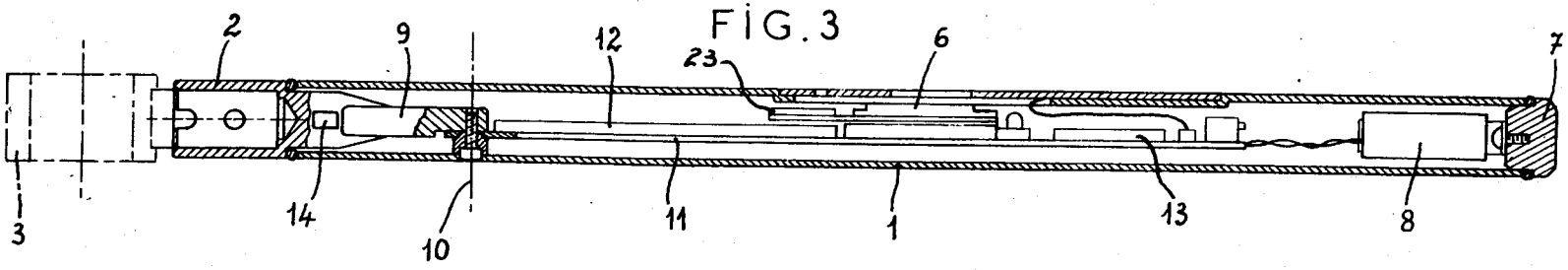
FIG. 3 is another axial section through the wrench of FIG. 1 but taken in a plane perpendicular to the section plane of FIG. 2.

As better seen in FIGS. 2 and 3, the tool end 2 is independent of the tubular body 1 and has a narrow stem 9*a* extending back to an anchor block 9 solidly fitted in the body 1, engaging both of its sides and constructed as described in further detail in my copending and jointly filed application Ser. No. 757,613 . A pivot or mounting pin 10 also secures this block 9 in place. Strain gauges 14 fixed to the stem 9*a* can produce an output, typically in the form of an impedance, which varies in an analog manner with the modest flexing of this stem 9*a*. Thus as the torque applied by the fitting 3 increases, the resistance of the gauge 14 on one side of the stem 9*a* will increase and that of the opposite gauge 14 will decrease. These gauges 14 are connected as is standard in a bridge circuit so that they respond identically to torque in either direction, allowing the wrench to be used upside down or for loosening as well as tightening.

Figure 4:
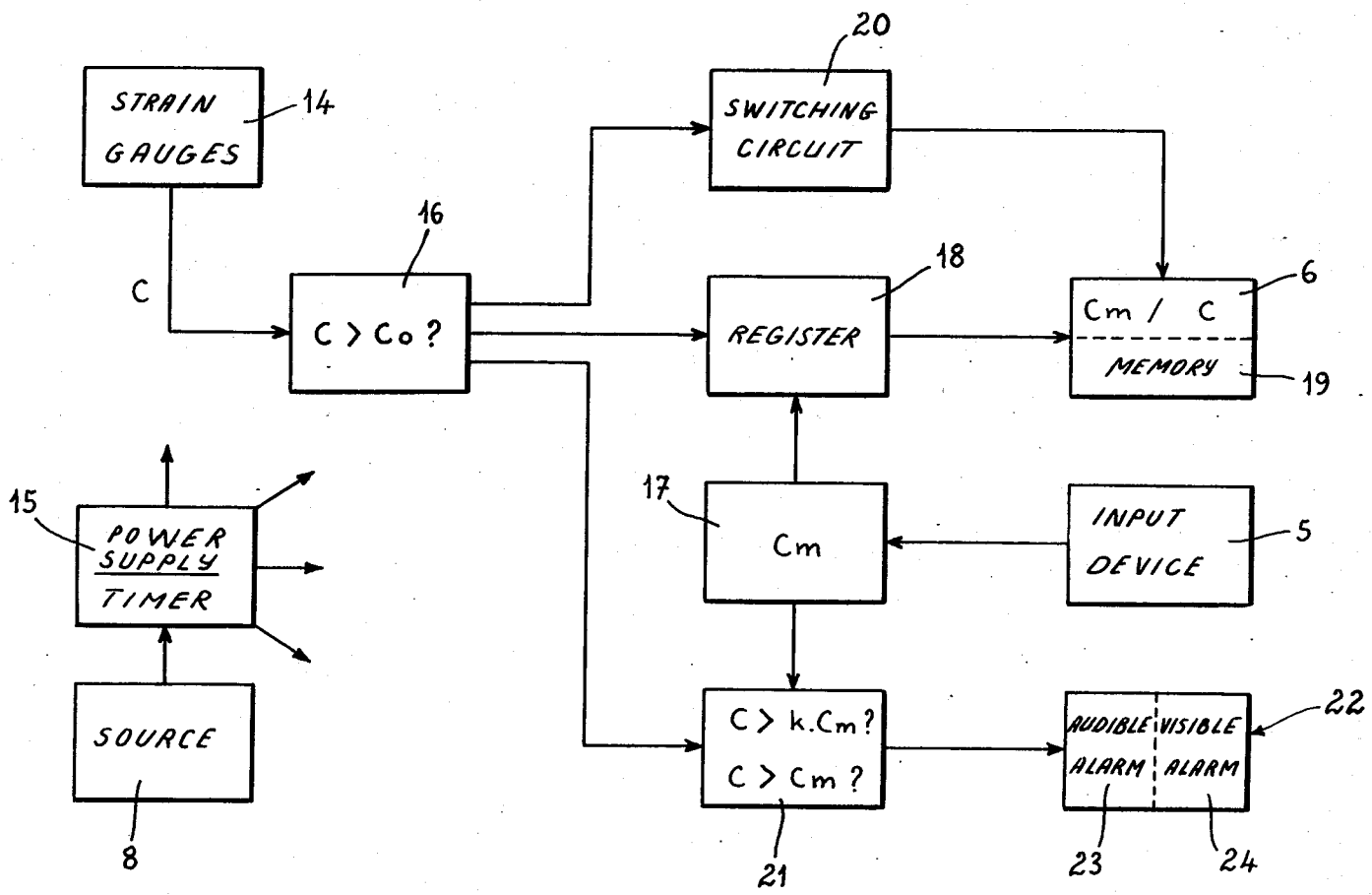
FIG. 4 is a schematic diagram of the torque wrench of this invention.

As best seen in FIG. 4 the battery source 8 is connected to a power supply or distributing circuit 15 connected to all the other elements of this system. The strain gauges 14 produce an actual-value output C equal to the torque actually being applied to the part in the fitting 3. This output C is fed to a comparator circuit 16 which compares it to a threshold torque Co of a relatively low level, for instance 15 Nm.

The input device 5 feeds via a circuit 17 the desired-value torque Cm both to a register 18 and to another comparator 21. The latter comparator 21 also receives the actual-value signal C from the comparator 16 and is connected to an audible alarm 23, a beeper, and to a visible alarm 24, a small lamp, of an alarm circuit. When the actual-value signal C exceeds a predetermined fraction of the desired-value signal Cm, the audible alarm 23 is activated. Here the comparator 21 multiplies signal Cm by a factor k equal to 0.9 to establish another threshold torque so that when the wrench is applying a torque equal to nine-tenths of the desired torque, the alarm 23 is sounded. When the desired-value signal C is equal to or greater than the desired-value signal Cm, the visible alarm 24 is activated. Thus the user can work rapidly, pulling hard on the wrench until the desired torque is nearly attained, then working carefully to achieve the desired torque accurately.

The register 18 receives the actual-value signal C from the comparator 16 and the desired-value signal Cm from the input circuit 17 and feeds both these signals to a memory 19 associated with the display 6. This display 6 in turn is operated by a switch circuit 20 triggered by the comparator 16 so the display 6 reads out the desired torque Cm so long as the actual torque C is less than the threshold torque Co, and is switched over to read out the actual torque C when it exceeds the threshold torque Co. Thus the user can set the desired torque using the buttons 5, which are typically set up to include fast-advance, slow advance, set, and reset functions, and this desired torque Cm will be displayed during the setting operation. Once the wrench is used to apply sufficient torque to exceed the low threshold value Co, the display 6 is automatically switched over by the circuit 20 to show the actual torque C. Thus it is fairly easy for the user to monitor how the operation is progressing.

The memory 19 also stores for about 5 sec the actual torque C fed to it. The display 6 will therefore for a brief time continue to display the most recently received and highest actual-value torque C so that if the wrench is repositioned or the user changes grip, there will be no display change until the newly applied torque exceeds the previous maximum.

Similarly the circuit 17 includes a short-term nonvolatile memory so that it retains the desired-value torque Cm for two to three hours, even if the wrench is not used or turned off. This allows, for instance, the wrench to be set for a given operation and used on and off during the day without requiring resetting with each use.

In addition the power supply 15 includes a timer circuit which shuts down the entire device if for 3 min the torque C does not exceed the threshold Co. Thus once the device is turned on it will remain on for 3 min, but if not used for 3 min, it will automatically shut down and will need to be turned back on for reuse.

The wrench according to this invention is therefore extremely easy to use. The user need not expressly program it for each use so long as the setting is the same, and need not remember to turn it off if it is not to be used for a while. Similarly when used on and off it will retain the previous setting. The user can work rapidly, as once the threshold torque Co is exceeded a display is given of the actual torque C, and when the desired torque Cm is neared, an alarm is given to warn the user to be careful and not overtighten or overloosen the part being worked on.

I claim:

1. A torque wrench comprising:

a rigid elongated body having a tool end adapted to be rotationally fixed to a part to which a predetermined desired torque is to be applied and an opposite handle end;

transducer means including strain gauges connected between the tool end and the body for generating an actual-value output corresponding to the actual torque being applied by the wrench to the part rotationally coupled to the tool end;

display means connected to the transducer means and including a display on the body for reading out torque;

input means also connected to the display means for generating a desired-value output corresponding to the desired torque to be applied by the wrench to the part rotationally coupled to the tool end;

first comparator means connected to the transducer and to the input means for comparing the actual-value and desired-value outputs and generating an alarm signal when the actual torque is substantially the same as the desired torque;

second comparator means connected to the transducer means for comparing the actual torque with a relatively low threshold torque; and switch means connected with the display and operated by the second comparator means for displaying the desired-value output when the actual torque lies below the relatively low threshold torque and for displaying the actual-value output when the actual torque exceeds the threshold torque.

2. The electronic torque wrench defined in claim 1 wherein the display means includes a memory for retaining and displaying for a limited time the actual torque even when same drops briefly below the threshold torque.

3. The electronic torque wrench defined in claim 1 wherein the first comparator means includes a first alarm;

a second alarm distinguishable from the first alarm; and means for actuating the first alarm when the actual torque is a predetermined fraction of the desired torque and for actuating the second alarm when the actual torque is generally equal to the desired torque.

4. The electronic torque wrench defined in claim 3 wherein the fraction is approximately nine-tenths.

5. The electronic torque wrench defined in claim 3 wherein the first alarm is an audible alarm.

6. The electronic torque wrench defined in claim 3 wherein the second alarm is an visible alarm.

7. The electronic torque wrench defined in claim 1, further comprising a power supply in the body connected to all of the means and provided with timer means for deenergizing all of the means when the wrench is not used within a predetermined time span.

8. The electronic torque wrench defined in claim 7 wherein the timer means deenergizes all of the means when the actual torque does not exceed the threshold torque within the predetermined time span.

9. The electronic torque wrench defined in claim 1 wherein the transducer means is set up so that the actual-value signal is independent of torque direction.

10. The electronic torque wrench defined in claim 1 wherein the display includes a nonvolatile memory for retaining the actual-value signal even if the wrench is turned off.

* * * * *